US005687812A

United States Patent [19]

Gervais et al.

[11] Patent Number: 5,687,812

[45] Date of Patent: Nov. 18, 1997

[54] AIRCRAFT SAFETY WASH RACK

[75] Inventors: James R. Gervais, Swansea; Dana Eldredge, Middleboro, both of Mass.

[73] Assignee: The United States of America as represented by the Secretary of the Air Force, Washington, D.C.

[21] Appl. No.: 462,086

[22] Filed: Jun. 5, 1995

[51] Int. Cl.[6] ..... A62B 35/00; E06C 7/18

[52] U.S. Cl. ..... 182/3; 182/63

[58] Field of Search ..... 182/3, 63

[56] References Cited

U.S. PATENT DOCUMENTS

| | | | |
|---|---|---|---|
| 2,589,803 | 3/1952 | Haley | 182/36 X |
| 3,465,846 | 9/1969 | Jacobson | 182/36 |
| 3,860,089 | 1/1975 | Huggett | 182/36 X |
| 4,790,410 | 12/1988 | Sharp et al. | 182/36 |
| 5,002,152 | 3/1991 | Lebow | 182/3 |
| 5,297,651 | 3/1994 | Vandelinde | 182/3 |
| 5,343,975 | 9/1994 | Riches et al. | 182/3 |
| 5,363,940 | 11/1994 | Fahrion | 182/36 X |

OTHER PUBLICATIONS

"Rope Implements", A–SAFE/FPSA, Advertisement. No date available.

American Monorail, Advertisement/Specification. No date available.

"Electric Hoists and Trolleys", Lift–Tech International, Inc., Advertisement. No date available.

*Primary Examiner*—Daniel P. Stodola

*Assistant Examiner*—William A. Rivera

*Attorney, Agent, or Firm*—Stanton E. Collier

[57] ABSTRACT

The aircraft wash rack has a supporting frame being attached to the hangar ceiling and a safety track being specifically constructed for the particular aircraft shape is attached to the supporting frame. In order to construct the safety track, the aircraft is placed in the position where the cleaning occurs. A story pole is moved about the aircraft outer surface edges to measure the height of the track above the aircraft as well as to determine the position of the track on the aircraft upper surface. The track usually is about 2 feet or so from the wing edges. After this information is determined, the safety track is constructed and attached to the supporting frame. A roller guide is attached to the track with a rope therefrom which is further attached to a rope adjuster. This is attached to the maintenance person who would be wearing a harness. The length of rope between the person and the track would be on the order of about 10 feet and would remain essentially constant because the guide follows the above track. As the person moves over the aircraft surface, the roller guide would move to keep up with the person. Because of the closeness, a fall off the aircraft would result in a drop of only a few inches and at the most a foot. This invention is particularly suitable when the inventory consists of one type of aircraft, but could be easily adapted to other aircraft shapes because the track could be removed and another attached.

5 Claims, 3 Drawing Sheets

AIRCRAFT SAFETY WASH RACK

STATEMENT OF GOVERNMENT INTEREST

The invention described herein may be manufactured and used by or for the Government for governmental purposes without the payment of any royalty thereon.

BACKGROUND OF THE INVENTION

The present invention relates to aircraft, and, in particular, relates to the washing of the exterior of aircraft.

Periodic washing or, in other words, cleaning of the exterior of aircraft is required because of the buildup of unwanted residue, dirt, grim, etc. due to atmospheric pollution, airport air contamination from engine exhausts, leakage from the aircraft itself, coatings of anti-ice material, low levels of salt from flying near saltwater, etc. All of these unwanted material cause corrosion and thus must be removed periodically, usually about every 30 days.

Because of the many different configurations of aircraft from small single engine to large cargo aircraft, a high lift with a pressure spray can be used to remove most material, but more resistant materials require scrubbing with cleaners and thus personnel are required to walk on wings and body parts. Considering the height, any fall off of an aircraft can easily result in serious injury and even death.

In order to address the falling problem and the different aircraft configurations, a high tensioned cable with a roller assembly with a rope thereon has been used in the past. In an aircraft hangar, cables are installed on or near the ceiling. The cables may be over 30 feet or more above the aircraft. A guide is installed on the tracks and rolls thereon and ropes are attached to the guide. The maintenance person would be attached to the lower end of the rope. Because of the large wing size of some aircraft, a very long length of rope is required from the maintenance person to the track. In this case, if the maintenance person falls from the aircraft, the person may not hit the floor but will swing into other objects attached to the aircraft which may result in serious injury still.

Thus, there exists a need for a means of safely cleaning aircraft.

SUMMARY OF THE INVENTION

In the present invention, a supporting frame is attached to the hangar ceiling and a safety track being specifically constructed for the particular aircraft shape is attached to the supporting frame. In order to construct the safety track, the aircraft is placed in the position where the cleaning occurs. A story pole is moved about the aircraft leading and trailing edges and alongside the fuselage to measure the height of the track above the aircraft at various positions as well as to determine the position of the track on the aircraft upper surface by means of chalk marking from the story pole onto the floor. After this information is determined, the safety track is constructed and attached to the support frame. A roller guide is attached to the track with a rope therefrom which is further attached to a rope adjuster. This is attached to the maintenance person who would be wearing a harness. The length of rope between the person and the track would be on the order of about 10 feet. As the person moved over the aircraft surface, the roller guide would move to keep up with the person. Because of the closeness, a fall off the aircraft would result in a drop of only a few inches and at the most a foot. This invention is particularly suitable when the inventory consists of one type of aircraft, but could be easily adapted to other aircraft shapes because the track could be removed and another attached and/or changed in a shop to accommodate larger aircraft by adding track and slight modifications to the support frame.

Therefore, one object of the present invention is a wash rack that is adaptable to many different aircraft configurations.

Another object of the present invention is a wash rack that maximizes safety while allowing the maintenance person to move about the aircraft upper surfaces.

Another object of the present invention is a wash rack that reduces substantially the fall distance if the maintenance person does fall off the aircraft.

These and many other objects and advantages of the present invention will be readily apparent to one skilled in the pertinent art from the following detailed description of a preferred embodiment of the invention and the related drawings.

DETAILED DESCRIPTION OF THE PREFERRED EMBODIMENT

Figure 1:
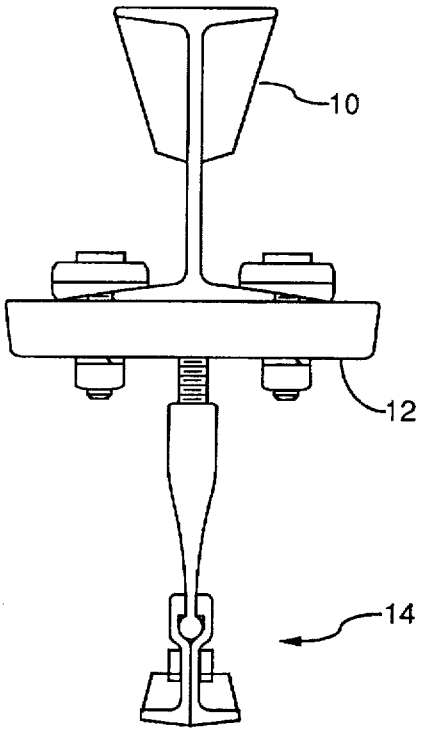
FIG. 1 illustrates an attachment of the support frame to a hangar beam.
Figure 2A:
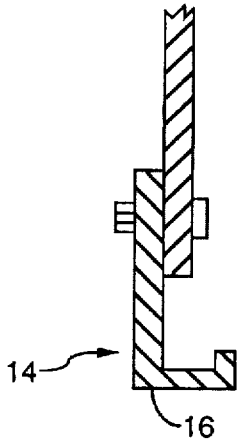
FIG. 2A, 2B and 2C illustrate various track means that are attached to the supporting frame.
Figure 2B:
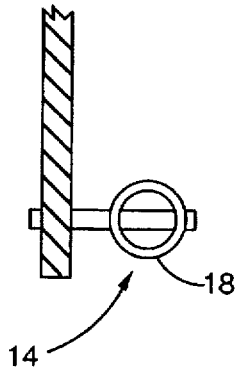
Figure 2C:
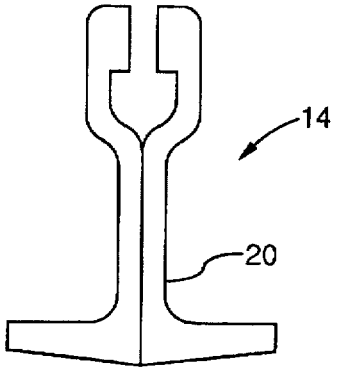

Referring to FIG. 1, a typical I beam 10 is shown that is used in aircraft hangar ceilings. Attached to the I beam 10 is a supporting frame 12 which can be directly attached to the I beam 10 or other ceiling beams by many conventional means. A safety track 14 is shown in FIGS. 2A, 2B and 2C. In FIG. 2A, the safety track 14 is a J-shaped rail 16 or as shown in FIG. 2B, the safety track 14 is a tubular rail 18. FIG. 2C illustrates a inverted T shaped rail 20 that is available from American Monorail, Inc., called No. D-401. This brochure being incorporated by reference. Also available are curved rail sections, trolleys for the tracks, accessories for the trolleys such as a swivel clevis for rope attachment, and accessories for attaching the track to the supporting structure. Each track shape can be bent and sections attached together. For example, with tubing, one end is reduced in size to fit within a normal size.

Figure 3:
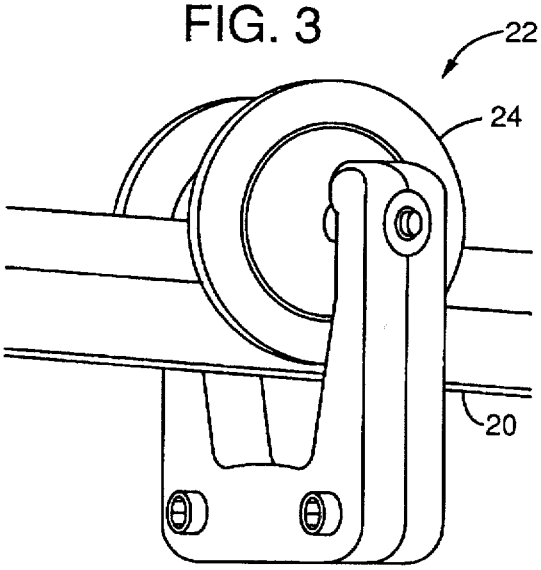
FIG. 3 illustrates a guide which is attached to a T-shaped track.
Figure 4:
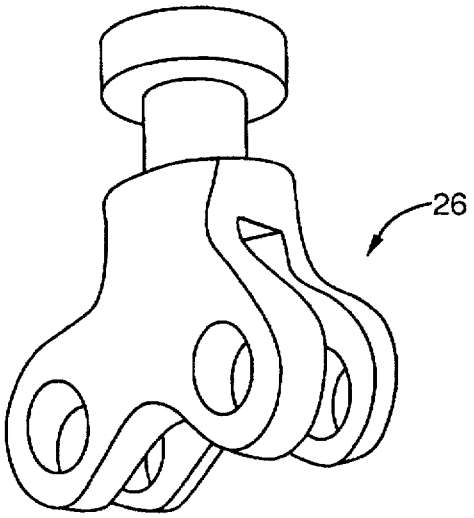
FIG. 4 illustrates a clevis that is attached to the guide of FIG. 3.
Figure 5:
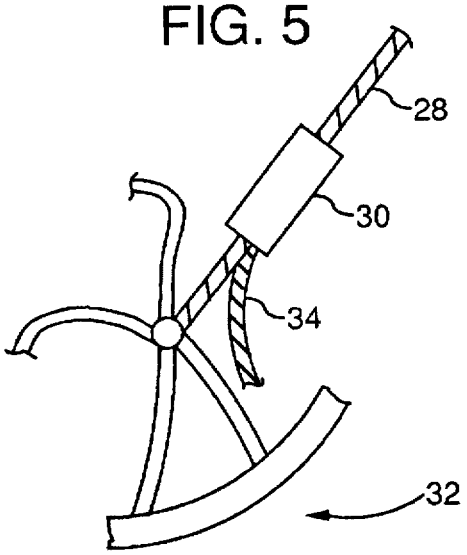
FIG. 5 illustrates a rope connected to a harness having an adjustable rope control means, one of many types, thereon.
Figure 7:
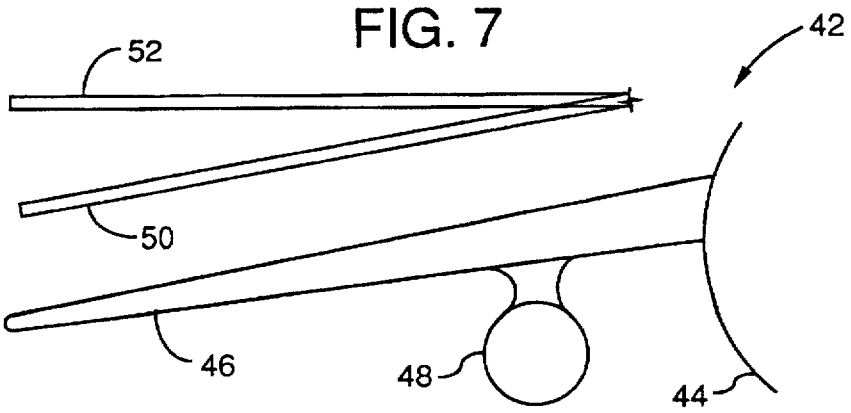
FIG. 7 illustrates a partial front view of an aircraft with a sloping wing and tracks thereabove.
Figure 6:
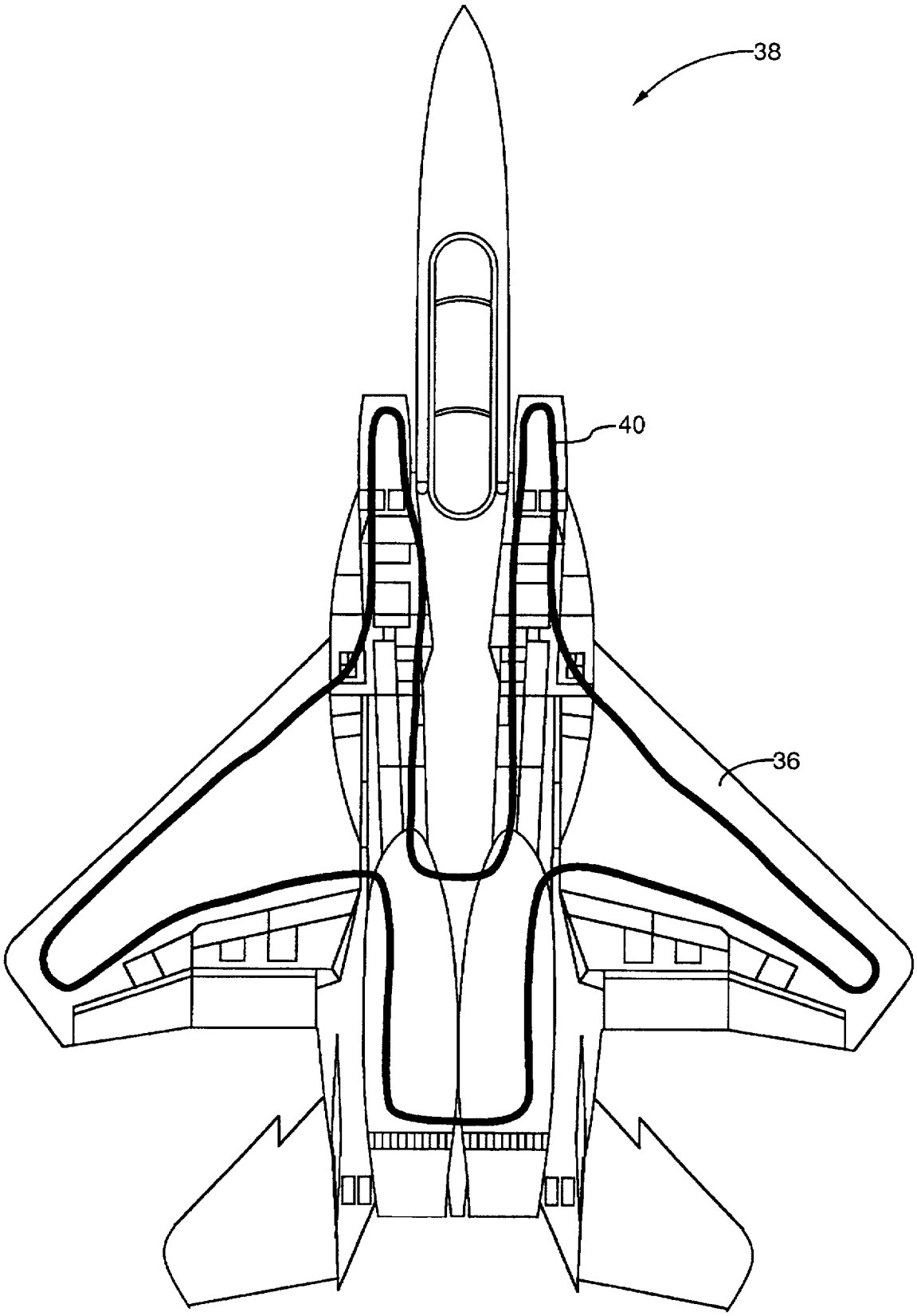
FIG. 6 is a top view of the track over a F-15 aircraft.

Referring to FIG. 3, a guide 22, also called a trolley, is shown attached to the track 20. Wheels 24 would ride smoothly along the track 20 with the assistance of greased bearings as the maintenance person moves about the aircraft surface. The guide 22 shown has a pair of wheels 24 but other styles of guides are available having two or three pair of wheels. The two criteria for this guide are light weight for ease of movement and the amount of weight that it can hold. Attached to the bottom of the guide 24 is a swivel attachment 26 as shown in FIG. 4. A rope 28 is connected thereto. The rope would be connected to an adjustable rope control means 30, FIG. 4, and then would be connected to a personal harness 32. The rope adjuster control means are conventional devices such as shown in company flyer of A-Safe, FPSA, being called "Rope Grabs," such as devices FP2561 to FP2563 and FP3521, FP3571 and FP3572. This flyer being incorporated by reference. As the maintenance person moves over the aircraft surface, the rope 34 would be adjusted therein so as to minimize slack in the rope 28. The harness/control means/rope/guide should support at least 500 to 1000 pounds. The track 14 would be approximately 10 feet or so above the aircraft surface 36 as seen in FIG. 6. FIG. 7 illustrates a front view showing partially an aircraft 42 having a fuselage 44 with a sloping wing 46 with an engine 48 thereon. In the preferred embodiment, a track 50, FIG. 7, would be a fixed distance above the wing aircraft surface. For example, in a large aircraft such as a KC-135, C-141 or C-5, there may be a 3 to 5 feet difference between the wing tip and the wing root, i.e., the wing part nearest the fuselage. Thus the track would slope towards the wing tip. It is assumed that the height difference would take into account a loaded versus unloaded wing. In another embodiment, a track 52 would be parallel to the floor but still designed to be a sufficient height above the aircraft for a maintenance person to walk around the track. FIG. 6 shows an F-15 aircraft 38 by top view. The enhanced dark line 40 represents the track 14 above the aircraft 38. The vertical height of the track 14 would vary above the aircraft 40 so as to keep the distance therebetween essentially constant so that the maintenance person would not have to adjust the rope length constantly. Once adjusted, the person could move along the entire track 14 with ease and complete safety because the amount of slack would be minimized at any particular position. Additional persons could work on the aircraft without interfering. Although the aircraft 40 shown is a fighter type aircraft, the invention could be easily adapted to other aircraft.

The wash rack is fabricated in the following manner: The aircraft is positioned in the wash rack area. An outline of the aircraft is placed on the floor using a story pole which is moved along the leading and trailing edges and the side of the fuselage. The position of the wash rack over the outline is marked and the story pole is used to determine the slope of the track at various positions over the line 38. With this information the track 14 can be constructed as well as the supporting frame 12. The track 14 is attached to the supporting frame 12 and raised to the correct position and then the supporting frame 12 is connected to the hangar ceiling.

Because of safety concerns, the supporting frame, track, guide, etc. should be inspected periodically, for example, every 30 days, for cracked welds, loose bolts, and worn parts. Weight tests on the supporting frame, track and harness components should also be performed periodically, for example, every 6 months or once a year. Grease and lubrication should be applied periodically to all critical locations should as on the rollers and on the track, for example, every 60 days.

Clearly, many modifications and variations of the present invention are possible in light of the above teachings and it is therefore understood, that within the inventive scope of the inventive concept, the invention may be practiced otherwise than specifically claimed.

What is claimed is:

1. An aircraft wash rack adapted to substantially follow an outline of an aircraft, said aircraft wash rack comprising:

a supporting frame, said supporting frame being attached to a hangar ceiling;

a track, said track being positioned directly over a predetermined line, said predetermined line being approximately several feet to the inside of an outside edge of said outline of said aircraft, said track being a predetermined retical distance from the surface of said aircraft;

at least one guide, said guide being movably attached to said track;

a rope, said rope being attached to said guide;

an adjustable rope control means for preventing the uncontrolled feedout of said rope, said adjustable rope control means being attached to said rope attached to said guide; and a harness, said harness being attached to said adjustable rope control means whereby a maintenance person having said harness thereon who is washing an aircraft is able to move along a path on said aircraft under said track and wash substantially all of the upper surface of said aircraft while minimizing a risk of injury from falling off said aircraft upper surface.

2. An aircraft wash rack as defined in claim 1 wherein said track is a closed loop.

3. An aircraft wash rack as defined in claim 1 wherein said track is substantially a fixed distance above the aircraft surface whereby when said maintenance person walks along said path under said track, said rope remains at about the same length.

4. An aircraft wash rack as defined in claim 3 wherein said track is approximately ten feet from said aircraft surface.

5. An aircraft wash rack as defined in claim 4 wherein the rope is of a length that includes an amount of slack, said amount of slack being minimized to prevent a fall greater than about a foot if the maintenance person fell off said aircraft.

* * * * *